United States Patent [19]

Sandrini et al.

[11] Patent Number: 4,722,473

[45] Date of Patent: Feb. 2, 1988

[54] RIGID, MULTIPURPOSE, POLYHEDRIC STRUCTURE WHICH CAN BE FOLDED AWAY ON ITS OWN BASE

[75] Inventors: Furio Sandrini, Milan, Italy; Rolf Neumann, Tasmania, Australia

[73] Assignee: Fashion Design Studio S.r.l., Milan, Italy

[21] Appl. No.: 744,790

[22] Filed: Jun. 14, 1985

[30] Foreign Application Priority Data

Jun. 22, 1984 [IT] Italy ..... 21569 A/84
Jul. 6, 1984 [IT] Italy ..... 21805 A/84

[51] Int. Cl.[4] ..... B65D 5/36

[52] U.S. Cl. ..... 229/41 R; 220/7; 220/71; 229/23 R; 229/122; 229/199; 312/292

[58] Field of Search ..... 229/23 R, 41 R, 41 B, 229/122, 199; 312/259, 292; 220/6, 7, 71; 190/103, 107, 127; 150/52 R, 52 F

[56] References Cited

U.S. PATENT DOCUMENTS

| | | | |
|---|---|---|---|
| 505,253 | 9/1893 | Sanborn | 229/23 R |
| 894,699 | 7/1908 | Rollestone | 229/41 R |
| 930,113 | 8/1909 | Adams | 229/41 R |
| 1,921,946 | 8/1933 | Rudowitz | 229/41 R |
| 1,980,482 | 11/1934 | Golden | 229/122 |
| 2,159,069 | 5/1939 | Zalkind | 312/259 |
| 2,987,236 | 6/1961 | Strine | 229/199 |
| 3,058,445 | 10/1962 | Johnson | 220/6 |
| 3,156,371 | 11/1964 | Harrison | 220/6 |
| 4,010,865 | 3/1977 | Wilgus | 220/6 |

FOREIGN PATENT DOCUMENTS

| | | | |
|---|---|---|---|
| 724505 | 12/1965 | Canada | 229/41 B |
| 420544 | 11/1910 | France | 229/41 R |
| 1247222 | 10/1960 | France | 229/34 |
| 467246 | 12/1951 | Italy | 229/41 B |

*Primary Examiner*—George E. Lowrance
*Assistant Examiner*—Gary E. Elkins
*Attorney, Agent, or Firm*—Bucknam and Archer

[57] ABSTRACT

A rigid, multipurpose, polyhedric structure which may be folded away on its own base has a base, a roof, vertical lateral surfaces (3), (4) and (5) provided with grooved fold lines extending along the diagonal of each lateral surface, and a side surface free on at least three sides, connected together by a continuous flexible layer. The base and the roof may be provided with fold lines or grooves extending along a diagonal of each. The surfaces can be made either from a multilayer material consisting of a continuous, flexible layer and rigid parts fixed to said layer or from plastic material and can be partially open and bordered.

19 Claims, 14 Drawing Figures

Fig. 1
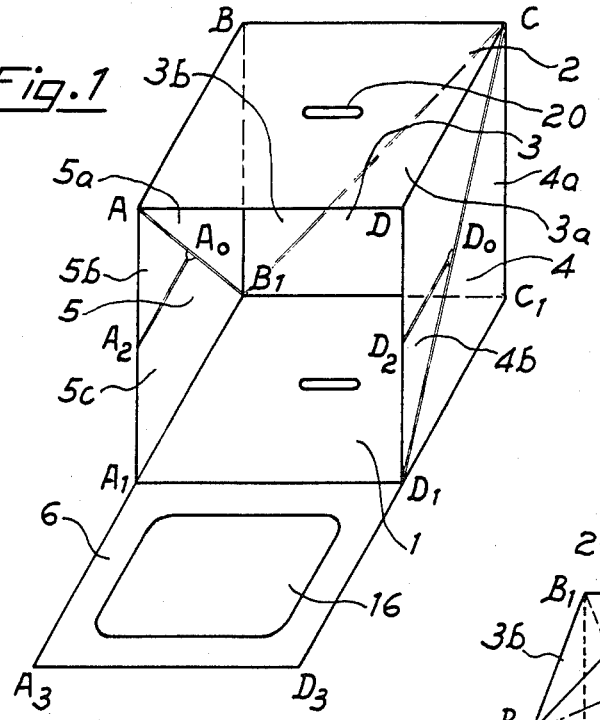
Fig. 2
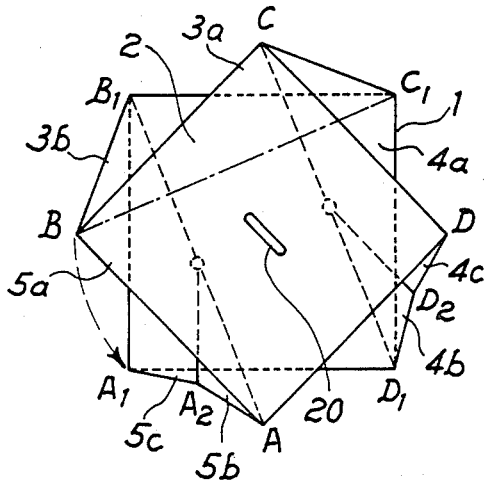
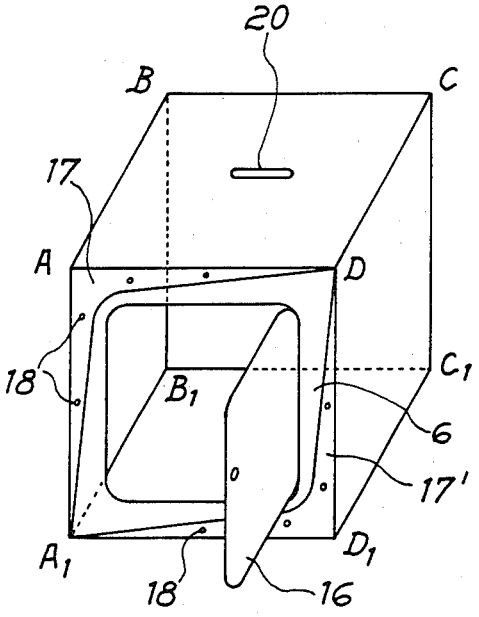
Fig. 4

Fig. 3A
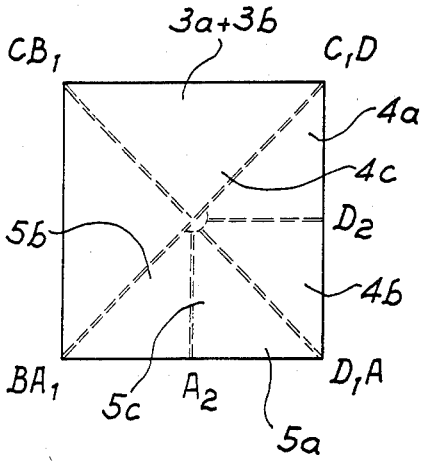
Fig. 3B
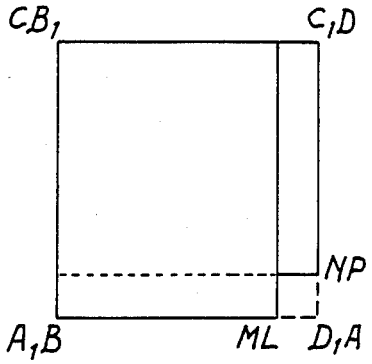
Fig. 7A
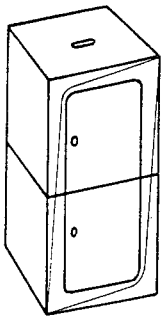
Fig. 7B
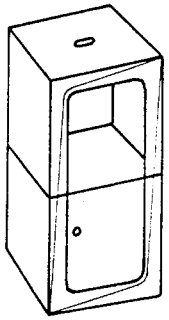
Fig. 7C
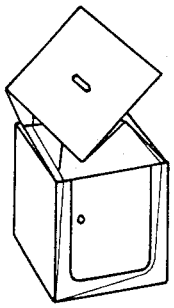
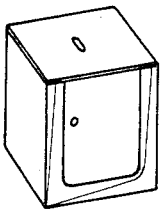
Fig. 7D Fig. 8
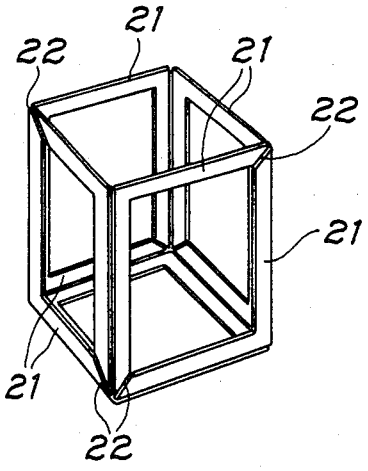
Fig. 9
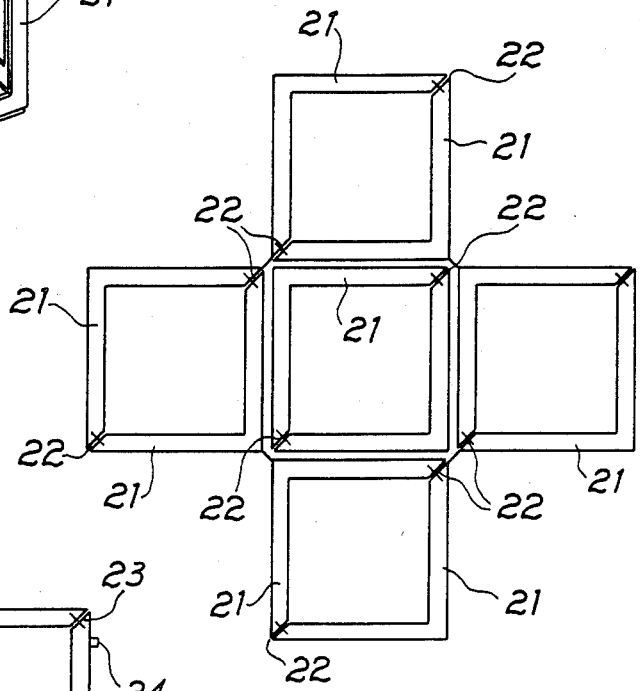
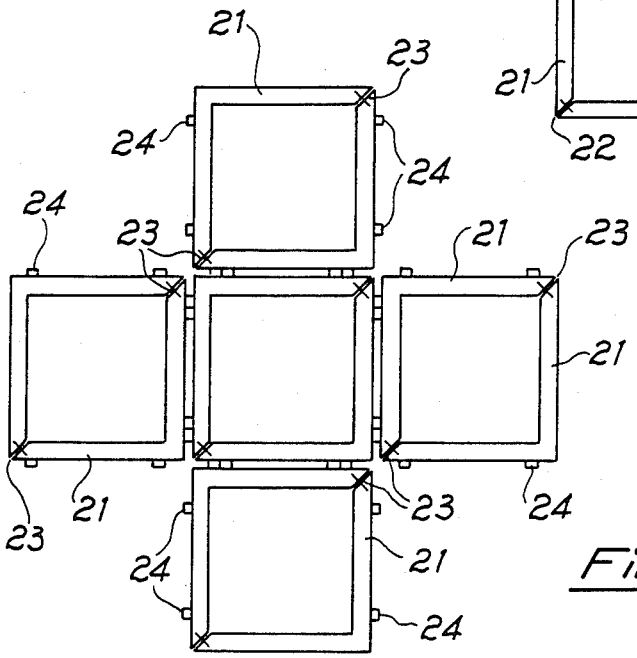
Fig. 10

RIGID, MULTIPURPOSE, POLYHEDRIC STRUCTURE WHICH CAN BE FOLDED AWAY ON ITS OWN BASE

BACKGROUND OF THE INVENTION

The present invention describes a rigid, multipurpose, polyhedric structure which can be folded away on its own base.

The term "structure" as used in the present description and in the claims embraces containers; pieces of furniture such as stools, chairs, armchairs, beds, cupboards; walls; a furnishing component structure; suitcases; toys; display stand for publicity purposes; base for support or leaning; animal cage; tents for camping and in general, any element whatsoever that can be folded away after use.

In the field of packing, storage or transport of solid or liquid materials or of animals or plants, as also in that of the fixed furnishing of civil or industrial premises, or mobile such as for camping tents and their equipment; in the fields of luggage and handbag production, of toys or collection of same and many similar uses, there are many and specific requirements. However, the requirement common to all these fields is that of having available a structure which, starting from a folded storage shape, can be expanded to its usage shape without involving any extraneous means and, after use, can be folded down to a minimum bulk such as its own plan. Moreover, these structures are often required to be stackable or connectable, and it is even better if they can be doubled, still, however, remaining collapsible with minimum bulk.

Another desirable characteristic is that the corners of the structure remain continuous so that, when expanded, the liquid or powder containing function or even only that of protection or support is completely performed; preferably without involving extraneous means.

In the packing field, especially for sending products to warehouses or distribution or consumer centers, numerous types of casing are known in wood, cardboard, or plastic materials etc. Generally, the types of casing known consist of parts to be assembled at the moment of use, or flattened boxes which are very bulky when flat, to be prepared for use by stapling, by glueing or strapping which, as it is known, causes time loss and the use of extraneous material.

For industrial transport many pallets have been made with metal or plastic collapsible walls.

In these, however, during the folding away, the walls separate along the vertical corners and, in many cases, they occupy, when flat, an area up to double their own base. These containers are bulky and in general without a cover, so that they are not suitable for packing products which need to be stored away from contact with dust, or even only with air, for hygienic reasons, as for example, foodstuffs, or for packing products whose shape and cleanliness must be preserved, such as clothing products.

The principal object of the present invention is to provide a collapsible structure which does not have the aforementioned disadvantages.

More particularly, the principal object of the present invention is to provide a structure which has the corners functionally continuous and which folds away on its own base.

An object of the present invention is to provide a structure which, apart from being collapsible onto its own base, can be stacked and connected so as to increase its useful caacity.

BRIEF SUMMARY OF THE INVENTION

According to the present invention, these and other objects are achieved by means of a multipurpose, rigid, collapsible, polyhedric structure consisting of:

(a) a base and a roof made of regular polygons, preferably with an even number of sides;

(b) $(n-1)$ lateral surfaces, where n is the number of the sides of the base polygon, and (c) a lateral surface which is free on at least three sides, connected to a side of the base, of the top, or of one of the other lateral surfaces; in the base, top and lateral surfaces are connected together in a flexible way and at least the lateral surfaces are provided with grooves or concurrent fold lines which extend along the diagonals of each side.

The presence of the fold grooves along the diagonals of the lateral surfaces enables the container to be folded away on its own base by rotation and lowering of the base or the top, when the free lateral surface is tilted or temporarily or permanently removed.

A further folding of the multipurpose structure of the present invention can be obtained by providing the base or the top also with fold grooves along diagonals provided therein.

The simplest embodiment of the present invention consists of a structure composed of a base, a rigid or flexible roof, lateral surfaces, connected in a collapsible way to the roof and to the base and provided with fold grooves along one diagonal. A side surface free on three sides and affixable as the nth side of the prism. All the grooves are concurrent, i.e. inclined in the same direction.

In making the multipurpose structure which can be folded away on its own base, which is one object of the present invention, a multilayer material can be used, one of its layers being flexible and, preferably continuous, and another rigid or semi-rigid with gaps corresponding to the border of the lateral surfaces, along the diagonal or diagonals of the lateral surfaces with concurrent diagionals, either to the right or to the left. The flexible layer can be cloth, sized cloth or a sheet of metal or plastic, as long as it is not of the hardening type. When the base and the roof are squares, also the walls are squares or multiples of identical squares at the base.

It is in fact essential, to achieve the object of the present invention, that the vertical walls, even in sectors, rest completely on the base, so as to make a multilayer sandwich when the structure is closed.

A polyhedric structure with a larger number of functions can be obtained by introducing the characteristic of diagonal, concurrent folding on all the surfaces.

According to the present invention, each surface is provided with a single folding groove along its diagonal; but it can be provided folding grooves, that is, both clockwise and counterclockwise. The latter is achieved by providing each surface with a double series of congruent diagonal grooves, when this is desired.

In any case, the walls of each side are kept contiguous by a thin, flexible, continuous or non-continuous layer. The possibility of folding the base and/or the roof and the simultaneous presence of diagonals on the lateral surfaces, make possible an easy folding of the multipurpose structure and the formation of a great number of polyhedrons which can be used both for internal cavity (such as packing or luggage, a display stand for example) and for the out side surface (for example, reading desks, stools, display furniture, supports, etc.). Furthermore, the unification of the wall measurements means that the single walls can be produced in series. The walls can be made of any material, for example, plastic, where the subdivision created by the diagonals can be obtained during the moulding, between thicker or rigid areas and folding grooves in thin sheeting, but of the same material as the thick areas.

The walls can be made of transparent material, or they may consist of just the border.

BRIEF DESCRIPTION OF THE INVENTION

In order that the invention may be readily carried into effect, it will now be described with reference to the accompanying drawings, wherein:

FIG. 2 represents a top view of the container of FIG. 1 when it is being folded away;

FIG. 4 is a schematic perspective view of another embodiment the container referred to in the preceding Figs. when it is completely expanded and ready to be used;

FIGS. 7A, 7B, 7C and 7D are schematic perspective views of the double cube container obtainable with the foldable composite of FIG. 6, in the expanded form, with a top wing open, with the upper cube being folded and, finally, with the upper cube folded back on the lower one, respectively;

FIG. 8 is a perspective view of a further embodiment of the present invention in the form of a cube-shaped structure with empty walls and without the cover;

FIG. 9 is a plan development of the structure of FIG. 8; and

FIG. 10 is a plan development of the structure of FIG. 8 in which the various sides are connected together by hinges.

DETAILED DESCRIPTION OF PREFERRED EMBODIMENTS

Figure 1A:
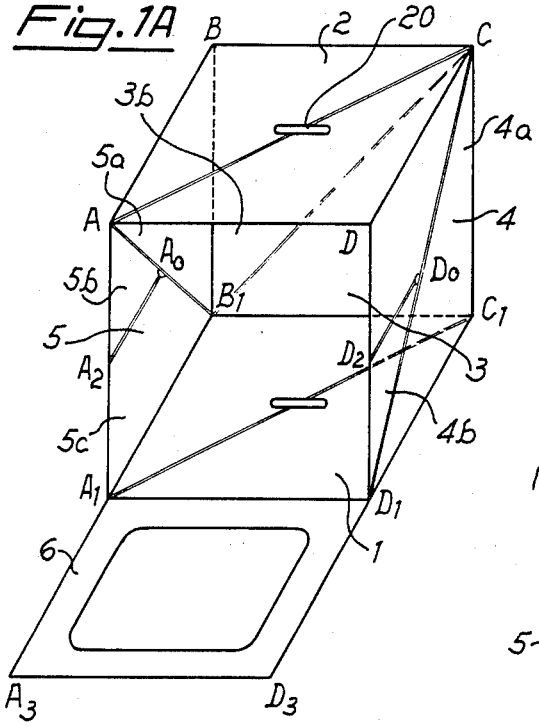
FIG. 1 is a perspective schematic view of an embodiment of the structure of the present invention, as a cubic container.

As shown in FIGS. 1 to 5, the collapsible container of the present invention, represented by geometric lines, consists of a cubic prism with a square base (A1B1C1D1) and a square roof 2 (ABCD) of a rigid, or, if it is the case, flexible plane without folding or bending grooves. The three vertical surfaces, 5 (AA1 BB1), 3 (BB1 CC1) and 4 (CC1 DD1), which can fold along all the corners, are applied between the surfaces, base 1 and roof 2.

The fourth vertical surface consists of the square 6 (A1A3D1D3) (shown in FIGS. 1 and 4 tilted outwards for better clarity) flexibly attached along the side A1D1 of base 1 and which can be inserted between the sides A1A, AD and DD1 of the other adjacent surfaces.

The side or lateral surface 6 can be held between the next adjacent surfaces by means of suitable fasteners or catches which, when removed, enable said surface to be tilted to the inside until it rests on base 1.

Alternately, the surface 6 can be provided with edges which surround the lateral surfaces of the container when expanded.

Each lateral vertical surface 5, 3 and 4 has diagional fold lines or fold grooves (AB1; BC1; CD1) inclined congruently, that is, either all towards the right, or all towards the left. Furthermore, the corners of the vertical surfaces 3, 4 and 5 are connected together by at least one continuous, flexible layer.

The greater part of the border of each surface consists of rigid or semi-rigid material with grooves along a diagonal, connected to the coherent parts and to the flexible ones by welding, glueing or stapling.

Figure 1B:
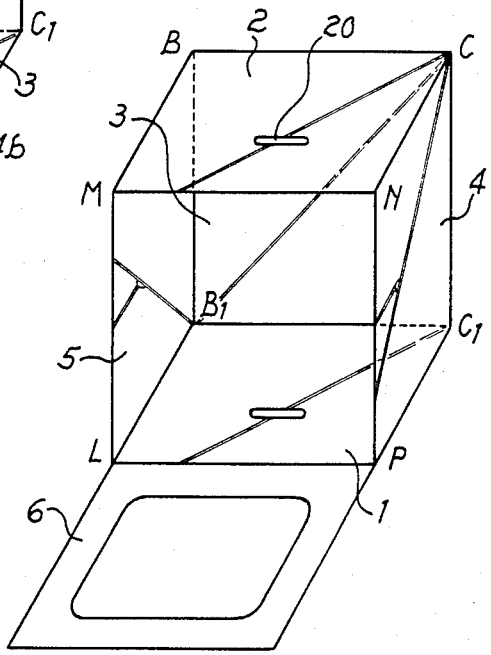
Figure 1C:
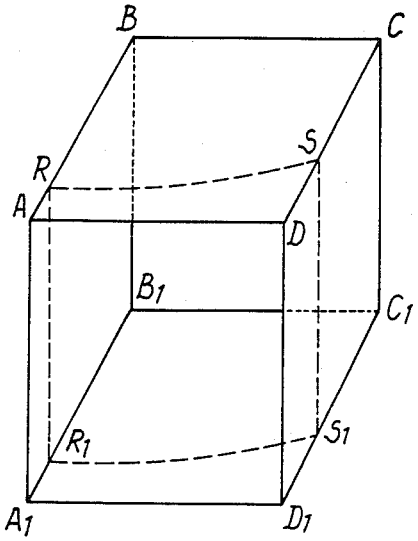

When surface 6 is tilted, as shown in FIGS. 1 and 4, or is folded inside against base 1, the cubic container can be subjected to folding by rotation of the roof 2 in relation to the base 1, forcing the surfaces 3, 4 and 5 to fold along the diagonals BC1, CD1 and AB1. This movement is kinematically possible due to aforementioned fold lines or grooves, and it can be facilitated, and some dead spots are easily overcome, if the two surfaces 4 and 5 are provided with two other auxiliary fold lines or grooves A2 A0 and D2 D0, parallel to the bases A1 B1 and D1 C1 and are placed approximately in the middle of the sides A1A and D1D, in correspondence with the opening side. In this preferred embodiment, a light push inside the container, in the proximity of A2 or D2 unbalances the structure and encourages the side walls to collapse, as shown in FIG. 2.

As shown in FIG. 2, the roof 2 (ABCD) rotates as indicated by the dotted arrow (direction defined by the inclination of the diagional fold lines) until B is brought to A1, A to D1, D to C1 and C to B1. In this way a reduction in the plan of the container is obtained, with the interpositioning of the lateral surfaces 3, 4, 5 folded within and above the base 1 and the movable surface 6 and under the roof 2.

The fold grooves are constructed to permit some play between the foldable parts in order to accommodate the thicknesses of the rigid parts during folding. Base 1 and roof 2 can also be provided with diagonal folding grooves.

Figure 5:
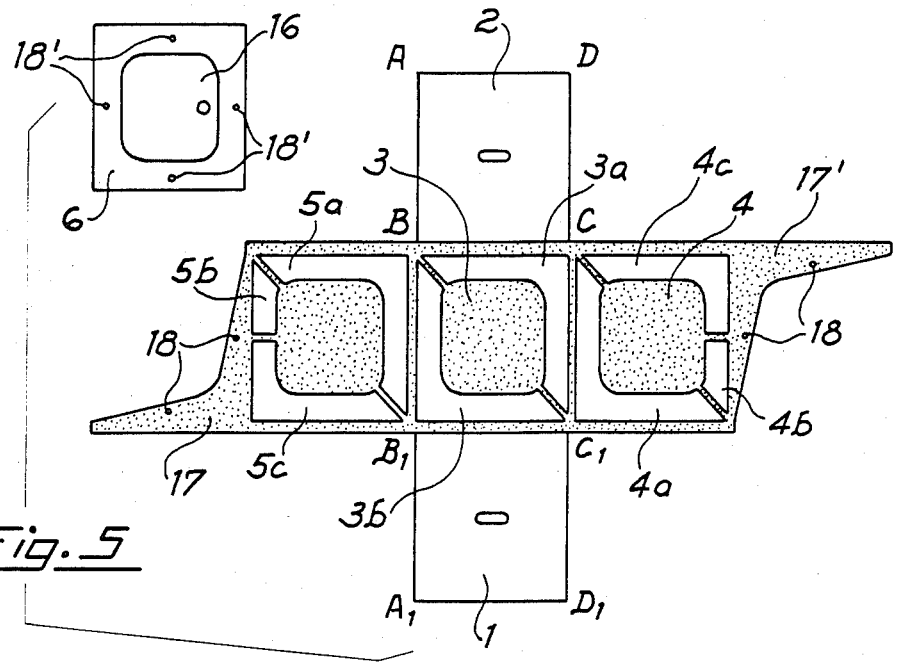
FIG. 5 is a plan view of the collapsible composite formed of cut, foldable, continuous and weldable pieces and by rigid pieces inserted to obtain the cubic container referred to in the preceding Fig.

FIG. 5 illustrates a particular type of embodiment of a cubic collapsible container collapsible by counterclockwise rotation. The surfaces are indicated by the same reference numerals as in FIG. 1 and have fold grooves, including auxiliary grooves A2A0 and D2D0.

The rigid, or, if it is the case, flexible parts, made in sectors *5a*, *5b*, *5c*, *3a*, *3b*, *4a*, *4b* and *4c*, centrally reduced in width for a lighter construction, are joined to the continuous flexible walls with spacing between the vertical surfaces, said spacing being different from that of FIG. 1 in relation to the base 1 and roof 2 and to the side surface 6.

Two arched strips 17 and 17', which, in the assembled cube, appear on the side of the mobile face 6, are joined to the continuous flexible surface.

These strips 17 and 17' are provided with two hooking devices 18, for insertion in their complementary part 18', with which the side surface 6 is provided. These hooking devices 18,18' may be of any type such as press buttons, zip-fastener, velcro, etc.

These hooking devices 18, maintaining the side surface 6 in abutment with the two vertical surfaces 4 and 5 and with the roof 2 when said side surface is closed, prevent the rotation and the folding up of the container along the fold lines AB1, BC1 and CD1. Alternatively, the slide surface 6 can be provided with a border which overlaps the lateral surfaces 3, 4 and 5 and the base 1 and the roof 2, when it is required.

In this position, the container is stable and rigid and appears as shown in FIG. 4. The expanded container can be obtained by traction and rotation, by means of a handle 20, until the cube A B C D A1 B1 C1 D1 is obtained; only surface AA1 DD1 remains open as long as the surface 6 is tilted within the cube.

This surface 6 may be rotated until it meets the edges of the surface AA1 DD1 and the arched strips 17 and 17' and is fixed thereto by the devices 18 and 18'. In this way the container is stable and can be used both in the aforedescribed condition or tilted, so that the surface 6 becomes horizontal.

As shown in FIG. 4, a hinged door 16 may be provided in the side surface 6. The door 16 permits the loading and unloading of loose material or the insertion of vessels into the container.

All the corners are continuously protected by the continuous flexible layer and by the arched and sealed strips 17 and 17'.

The flexible layer can be porous, such as cloth or netting, sized and waterproofed, or in continuous metal sheets, for example, aluminium or tin sheets, or plastics lamina such as polypropylene or polyester, depending on the use for which the container is destined, for example, storage of solid or liquid foodstuffs. The flexible layer may be also constituted of detachable parts connected by hinges, or other hooking devices.

Furthermore, the flexible layer can be a multiple layer, particularly consisting of an external and an internal part, for example, in the case of a container for the transport of solid or liquid foodstuffs, to create a perfectly conditioned inner chamber without breaks.

The collapsible container of the invention may be used as a more or less temporary habitation, such as a tent for camping, or for an emergency. In this case, portholes or aeration points should be provided the flexible parts, or in the rigid walls.

Figure 6:
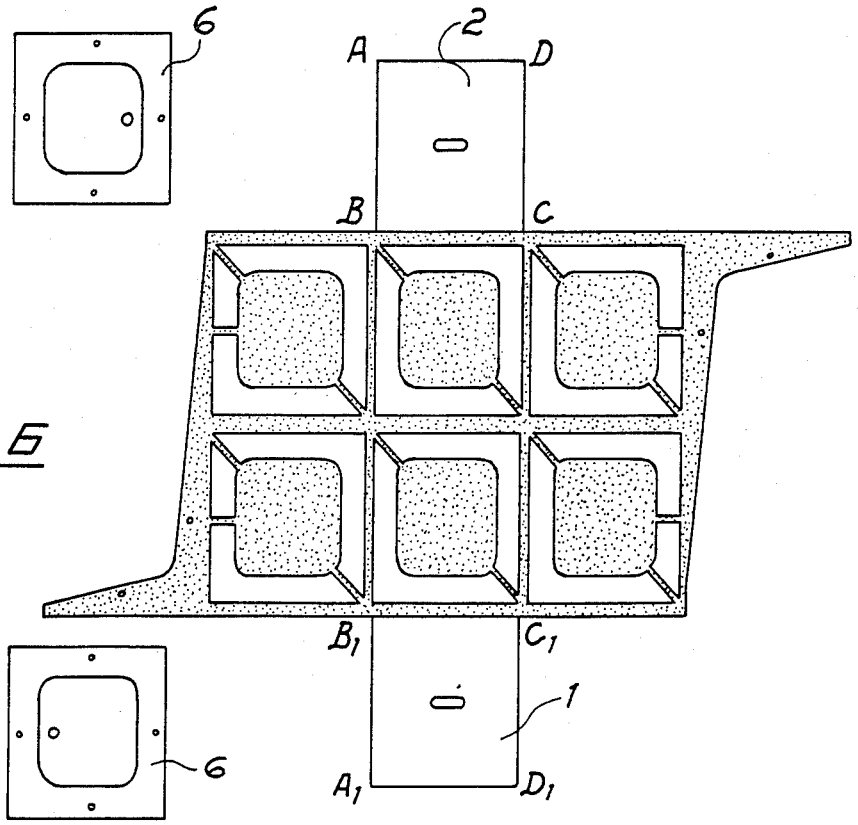
FIG. 6 is a plan view of another embodiment of the present invention in the form of a superimposed double cube without intermediary bases.

FIGS. 6 and 7 illustrate a multiple-height (in this case, double) container where all the basic cube structures illustrated in the preceding Figs. are repeated. The multiple height container is obtained by superimposing two or more of the units of FIG. 1 or 4, eliminating the intermediate base and using the plan development illustrated in FIG. 6.

In FIG. 7A, the multiple container is shown totally expanded and in FIG. 7B, the upper surface is against the top to permit the upper cube to be rotated and folded away, as shown in FIGS. 7C and 7D. The cube of FIG. 7D can be folded down, as stated hereinabove with reference to the cube of FIG. 1.

Figure 3C:
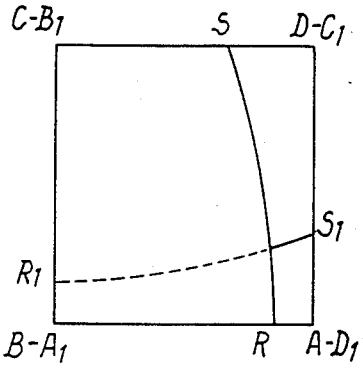
FIGS. 3A and 3B are a plan view of the container of FIG. 2 when the folding is completed.

Another particular variant of the structure of the present invention, is obtained by cutting the cube of FIG. 1 with a plane LMNP, or with a cylinder having an axis parallel to an edge of the polyhedric structure. The cutting plane can be parallel or oblique to a surface of the cube. In this way, the depth of the cubic structure is reduced while all the diagonals of the whole structure are maintained as also the plan dimensions, as shown in FIG. 3B, which shows the plan dimensions of the cut container with reference to those of the whole container in FIG. 3A.

The missing part is only the shaded area.

This cut produces truncated structures with collapsible characteristics. By folding and rotation with folding along the diagonals and on the base of the corresponding non-truncated virtual cube, more shallow containers are obtained in expansion.

The surfaces of the present polyhedric structure can be produced by moulding in one piece, from a single material which makes the triangles constituting the rigid parts of greater thickness, or, if required, with ribs and grooves of the same mould material, but in a thinner layer.

Furthermore, when its measurements exceed the potentiality or the cost of moulding in a single piece, the multipurpose structure of the present invention can be obtained by assembling similar surfaces.

The polyhedric structure of the present invention can also be formed of partially open and bordered surfaces, each consisting only of the border provided with fold grooves along one or both diagonals.

FIGS. 8, 9 and 10 show a cubic structure consisting of a base and four lateral surfaces. Both the base and each of the side surfaces are formed of two symmetrical half borders 21 extending along a diagonal of the surface, forming between them fold grooves 22. The half borders can be connected together, either by a continuous flexible support, or by means of hinges 23, as shown in FIG. 10.

The base and the four lateral surfaces may be connected by hinges 24.

The structure of FIG. 8 can also be used as a surface for supporting a person.

The uses, however diversified, and the coloring or partial mobile configurations on the surfaces of the polyhedric structure, or the reproduction of cartoon or drawn characters on the internal surfaces, or even the wall such as, for example, a curtain blind, fall within the scope of the present invention.

What is claimed is:

1. A polyhedric structure adapted to be folded down onto its own base, said structure comprising:

a base consisting of a polygon;

a roof consisting iof a polygon, said polygons of the base and the roof having an even number of sides;

(n−1) first lateral surfaces, wherein n is the number of sides of the base polygon, said first lateral surfaces joining said roof to said base and forming a prism, each of said first lateral surfaces having a diaginal line;

a side surface free on at least three sides and affixable as an nth lateral surface of said prism, said side surface having a tilting door; and a groove extending along the diagonal line of each said first lateral surface, said grooves being inclined in the same direction, said first lateral surfaces having corners, said corners being connected by at last one continuous, flexible layer, the first lateral surfaces contiguous to said side surface being provided with auxiliary folding lines parallel to the base, placed in the middle of said first lateral surfaces and in contact with said diagonal lines.

2. The structure according to claim 1, wherein said side surface is affixable to said base.

3. The structure according to claim 1, wherein said side surface is affixable to said roof.

4. The structure according to claim 1, wherein said side surface is affixable to said first lateral surfaces.

5. The structure according to claim 1, wherein said grooves extend along a single diagional of each said first lateral surface.

6. The structure according to claim 1, wherein at least said first lateral surfaces consist of multilayer material, said flexible layer being continuous and the other layers being rigid or semirigid with gaps corresponding to the border of the first lateral surfaces and extending along the diagonal of each of said first lateral surfaces.

7. The structure according to claim 1, wherein the continuous flexible layer extends in an arched strip from selected ones of said first lateral surfaces contiguous to said side surface, said arched strip having means for attachment to said side surface when said side surface is affixed to said prism.

8. The structure according to claim 1, further comprising a plane cutting said structure to form a different structure.

9. The structure according to claim 1, wherein said plane is oblique.

10. The structure according to claim 1, further comprising a cylinder having an axis parallel to one of the sides of said prism, said cylinder cutting said structure to form a different structure.

11. The structure according to claim 1, further comprising an additional structure according to claim 1 superimposed thereon.

12. The structure according to claim 1, further comprising an additional structure according to claim 1 placed side by side therewith.

13. The structure according to claim 1, wherein said base, said roof and said first lateral surfaces are connected by hinges.

14. The structure according to claim 1, wherein each of said base, said roof and said first lateral surfaces is formed by two symmetrical half borders extending along a diagonal and connected by hinges.

15. The structure according to claim 1, wherein each of said base and said roof has a diagonal line on the surface thereof and a groove extending along said diagonal line.

16. The structure according to claim 1, wherein said roof is rigid.

17. The structure according to claim 1, wherein said base is square and said structure is a cube.

18. The structure according to claim 1, wherein each lateral surface has two series of diagonal lines, one clockwise and the other counterclockwise.

19. The structure according to claim 1, wherein said roof is flexible.

* * * * *